US006137986A

United States Patent [19]

Sugino et al.

[11] Patent Number: 6,137,986

[45] Date of Patent: Oct. 24, 2000

[54] FIXING ROLLER FOR IMPROVING VOLTAGE RESISTANCE AND FIXING APPARATUS HAVING SUCH FIXING ROLLER

[75] Inventors: Osamu Sugino, Abiko; Nobuo Nakazawa, Toride, both of Japan

[73] Assignee: Canon Kabushiki Kaisha, Tokyo, Japan

[21] Appl. No.: 09/372,995

[22] Filed: Aug. 12, 1999

[30] Foreign Application Priority Data

Aug. 20, 1998 [JP] Japan ..... 10-234166
Jul. 28, 1999 [JP] Japan ..... 11-213789

[51] Int. Cl.[7] ..... G03G 15/20

[52] U.S. Cl. ..... 399/333; 219/216

[58] Field of Search ..... 399/328, 330, 399/331, 333; 219/216; 492/16

[56] References Cited

U.S. PATENT DOCUMENTS

| | | | |
|---|---|---|---|
| 4,179,601 | 12/1979 | Tarumi et al. | 219/216 |
| 5,403,995 | 4/1995 | Kishino et al. | 219/216 |
| 5,729,813 | 3/1998 | Eddy et al. | 399/333 |
| 6,002,106 | 12/1999 | Kataoka et al. | 219/216 |

FOREIGN PATENT DOCUMENTS

| | | |
|---|---|---|
| 58-23626 | 1/1979 | Japan . |
| 63-192071 | 8/1988 | Japan . |

*Primary Examiner*—Quana M. Grainger
*Attorney, Agent, or Firm*—Fitzpatrick, Cella, Harper & Scinto

[57] ABSTRACT

A fixing roller includes a conductive core member to which voltage is to be applied to an aluminum oxidation layer provided on the conductive core member and a surface conductive layer provided on the aluminum oxidation layer.

13 Claims, 2 Drawing Sheets

FIXING ROLLER FOR IMPROVING VOLTAGE RESISTANCE AND FIXING APPARATUS HAVING SUCH FIXING ROLLER

BACKGROUND OF THE INVENTION

1. Field of the Invention

The present invention relates to a copying apparatus of electrophotographic type, a fixing roller, and a fixing apparatus for fixing toner on a recording material to the recording material in an image forming apparatus such as a printer.

2. Related Background Art

In the past, although various fixing rollers and fixing apparatuses used with image forming apparatuses, such as general copying machines of electrophotographic type have been proposed and put to practical use, due to excellent mold releasing ability, a fixing roller in which resin of fluorine group is used as an offset preventing layer, has mainly been used. A fixing apparatus of so-called heat roller type having a pair of rollers in which at least one of the rollers is heated by a heat source has mainly be used in consideration of thermal efficiency. FIG. 4 shows a fundamental construction of such a fixing apparatus.

That is to say, FIG. 4 is a partial sectional view of a conventional fixing apparatus of heat roller type. In FIG. 4, a fixing roller 3 has a heat generating source such as a halogen heater 3*d* and the like therein and is constituted by a metal core 3*c* made of aluminum and the like. A primer layer 3*b* including PAI (polyamideimide), coated on the metal core, and an offset preventing layer 3*a* adapted to prevent occurrence of an offset phenomenon which is made of fluororesin such as PTFE and coated on the layer 3*b*. A pressure roller 2 is disposed below the fixing roller 3 having such a construction and is constituted by a metal core 2*b*, an elastic surface layer 2*a* made of rubber, and the like and coated on the metal core.

The fixing roller 3 and the pressure roller 2 are urged against each other and cooperate with each other to form an appropriate press portion (referred to as "nip portion" hereinafter), therebetween. The fixing roller and the pressure roller are rotated by receiving a driving force of a driving means of a main body of the image forming apparatus. By pinching, (sandwiching), and conveying the recording material bearing an unfixed image by the nip portion between the rollers 2, 3, the unfixed image is fixed to the recording material by heat and pressure.

However, in the above-mentioned fixing apparatus of heat roller type, since the recording material is directly contacted with the surface of the fixing roller 3, a part of the toner on the recording material is adhered to the surface layer, (offset preventing layer), 3*a* of the fixing roller 3, with the result that a so-called offset phenomenon, in which the adhered toner is transferred onto the recording material again by the rotation of the fixing roller 3, cannot be avoided.

In order to prevent occurrence of the offset phenomenon, generally, the surface layer, (offset preventing layer) 3*a* of the fixing roller 3 is coated by high mold releasing material such as fluororesin as mentioned above to improve the mold releasing ability. However, since such material has high resistance, the surface layer 3*a* is greatly charged due to frictional charging between the surface layer and the recording material, with the result that the toner on the recording material is adsorbed onto the surface layer 3*a* of the fixing roller 3, by the electrostatic action, thereby causing a so-called electrostatic offset phenomenon.

To avoid this, for the purpose of preventing occurrence of the electrostatic offset phenomenon, there has been proposed a technique in which fine particles having low resistance such as carbon black or titanium dioxide or whisker single crystal fibers such as potassium titanate, are added to resin material from which a surface layer 3*a* of a fixing roller 3 is made to reduce the resistance of the surface layer 3*a* of the fixing roller 3, thereby preventing the occurrence of the electrostatic offset phenomenon by preventing frictional charging of the surface layer 3*a* (for example, see Japanese Patent Publication No. 58-23626 and Japanese Patent Laid-Open No. 63-192071).

However, in a fixing apparatus having such a fixing roller, even though the offset can be eliminated effectively, since moisture included in the recording material is injected from the fixing nip portion toward a recording material convey inlet as vapor when the recording material enters into the fixing nip portion, an unfixed image on the recording material is scattered, (so-called "toner scattering" phenomenon). To avoid such toner scattering, it is known to apply voltage having same polarity as that of the developer, (toner), to the fixing roller.

However, when there is no high pressure resistance layer in plural layers on a metal core of the fixing roller for example, if voltage of 700 to 800 Volts is applied to the fixing roller, current will flow to the recording material through the surface layer, with the result that effect of application of voltage becomes less since fixing voltage is reduced. Further, since the charges for holding the developer on the recording material are decreased by the charges flowing into the recording material, the "toner scattering" becomes serious.

SUMMARY OF THE INVENTION

An object of the present invention is to provide a fixing roller and a fixing apparatus which can prevent toner offset and toner scattering.

Another object of the present invention is to provide a fixing roller and a fixing apparatus which can prevent toner scattering while maintaining heat conductivity of the fixing roller.

A further object of the present invention is to provide a fixing roller and a fixing apparatus, in which there are provided a conductive core material to which voltage is applied, an aluminum oxidation layer formed on the conductive core layer, and a surface conductive layer formed on the aluminium oxidation layer.

The other objects and features of the present invention will be apparent from the following detailed explanation of the invention.

DESCRIPTION OF THE PREFERRED EMBODIMENTS

The present invention will now be explained in connection with an embodiment thereof with reference to the accompanying drawings.

Figure 1:
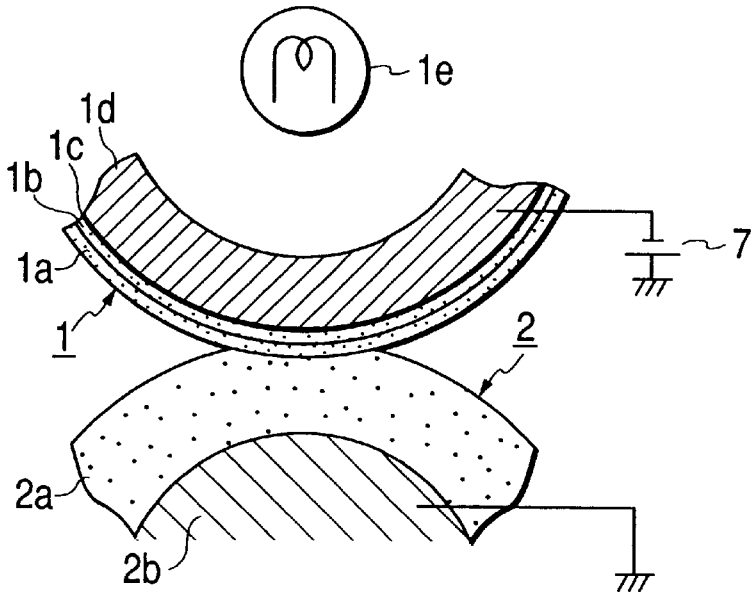
FIG. 1 is a partial sectional view of a fixing apparatus according to the present invention.
Figure 2:
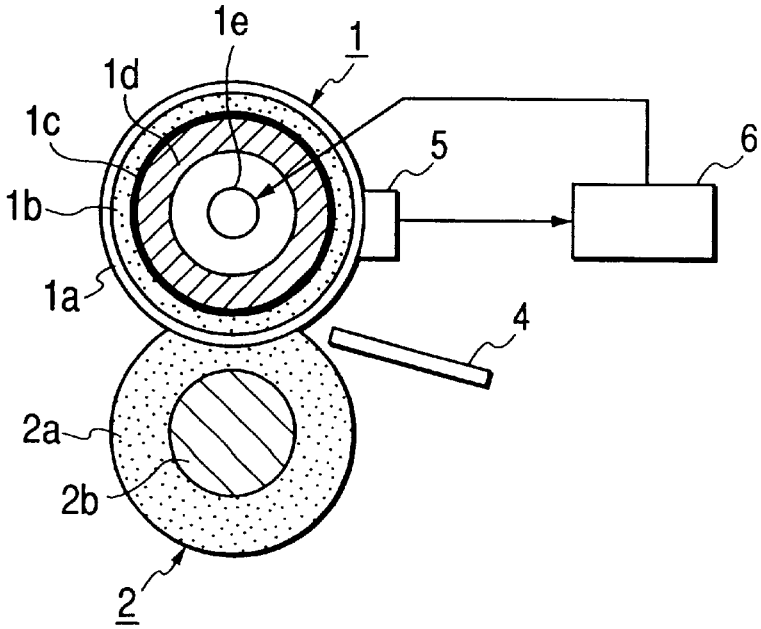
FIG. 2 is a sectional view showing an entire fixing apparatus according to the present invention.
Figure 3:
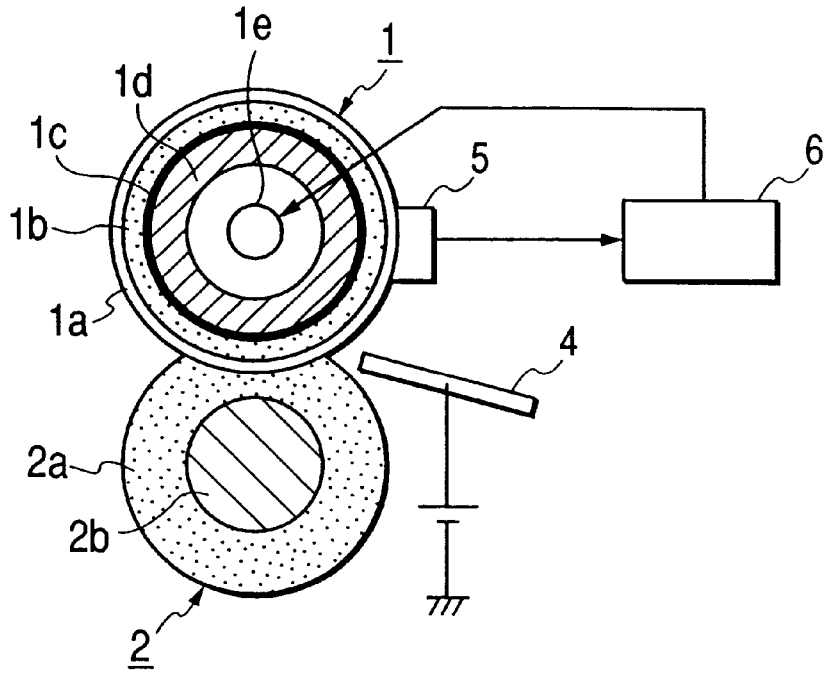
FIG. 3 is a sectional view showing an entire fixing apparatus according to the present invention.
Figure 4:
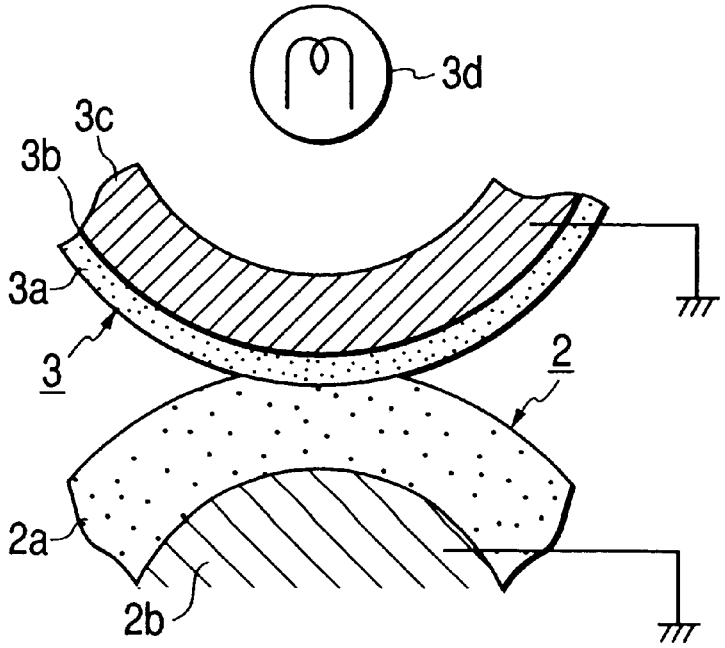
FIG. 4 is a partial sectional view of a conventional fixing apparatus.

FIG. 1 is a partial sectional view of a fixing apparatus according to the present invention, and FIGS. 2 and 3 are sectional views showing the entire fixing apparatus.

In FIGS. 1 and 2, a fixing roller 1 includes therein a heat generating source 1*e*, such as a halogen heater. A pressure roller 2 is constituted by a metal core 2*b*, and an elastic layer, (surface layer), 2*a* made of rubber or the like, and coated on the metal core.

The fixing roller 1 and the pressure roller 2 are urged against each other to form an appropriate abutment area, (referred to as "nip portion" hereinafter), therebetween. The fixing roller 1 and the pressure roller 2 are rotated by a driving means, (not shown), of a main body. Accordingly, a recording material on which an unfixed toner image is borne is guided by a fixing inlet guide 4, (refer to FIG. 2), to first contact with the fixing roller 1, and then is entered into the nip portion, where the unfixed toner image is fixed to the recording material by heat and pressure. Incidentally, in FIG. 2, the reference numeral 5 denotes a temperature detecting element such as a thermistor, and 6 denotes a temperature control means for controlling the heat generating source le on the basis of output from the temperature detecting element 5.

The fixing roller 1 is constituted by an aluminum metal core (conductive core material) 1*d*, an alumite coating layer (aluminum oxidation layer) 1*c* having a thickness of 10 to 15 μm and formed on the metal core by anode oxidation treatment, and a primer layer 1*b* including PAI (polyamideimide), in accordance with a conventional technique and coated on the coating layer. Further, as a top coat layer (surface conductive layer) 1*a*, a fluororesin layer such as PTFE, PFA or the like, including filler, (conductive material), is laminated on the primer layer. A sum of thicknesses of the top coat layer la and the primer layer 1*b* is selected between 26 to 30 μm. Further, there is provided a voltage applying means 7 for applying voltage having the same polarity as that of the developer (toner), to the fixing roller 1. For example, when developer having negative polarity is used, voltage of −700 to −800 Volts is applied to the fixing roller.

Incidentally, the primer layer lb serves to adhere the top coat layer 1*a* to the alumite coating layer 1*c*.

In the fixing roller 1, when voltage of 100 Volts is applied to the metal core 1*d* and a grounding electrode having cross-section of 10 mm×10 mm (square with side of 10 mm), is contacted with the surface layer 1*a* to 1*c*, since current does not flow, (regardless of a contact position), voltage resistance becomes 100 Volts or more.

However, if the surface layer does not include the alumite coating layer on the aluminum metal core, voltage resistance will become about 30 to 50 Volts.

Tests were performed by using fixing apparatuses including four kinds of fixing rollers having different voltage resistance to evaluate "scattering" in fixing operations. Incidentally, in the evaluation, a measure chart comprising lateral lines with a pitch of 2 to 3 mm was used. Such a pattern corresponds to a case where a table is formed by a personal computer and then is outputted. Further, images were formed by a reversal developing system, which is an image forming method used with digital machines such as printers. Since the reversal developing system may generate memory in the transferring, in the reversal developing system, great transfer current cannot flow, so that electrical attracting force between the developer and the recording material is reduced in comparison with a normal developing system, with the result that toner-scattering is apt to occur in the fixing operation.

Test results regarding the scattering in the four fixing apparatuses having different voltage resistance are shown in the following Table 1.

TABLE 1

| Voltage resistance (V) | Scattering level |
|---|---|
| 500 | A |
| 100 | B |
| 40 | C |
| 10 | D |

A : scattering was not noticeable at all
B : slight scattering occurred
C : scattering was noticeable
D : thorough scattering occurred Constructions of fixing rollers:

(10 Voltage resistance 500 V: aluminate/primer 15 μm/surface layer 20 μm (2) Voltage resistance 100 V: aluminate/primer 7 μm/surface layer 20 μm (3) Voltage resistance 40 V: primer 7 μ/surface layer 20 μm (4) Voltage resistance 10 V: primer 7 μ/surface layer 20 μm Further, regarding offset, levels were the same in four kinds (evaluated by using fine pitch lines).

The reason why the voltage resistance is 10 V in the above Item (4) is that the voltage resistance of the surface layer thereof is smaller than that of the surface layer in the above Item (3).

As a result, it was found that the rollers having therein the alumite coating layer (high voltage resistance layer) provide good effect for the scattering. When the primer layer is formed from insulation material, by increasing the thickness of this layer to increase the voltage resistance thereof, the same effect can be obtained. In this case, however, the thickness of the layer must be increased by two times or more in comparison with the normal thickness of 7 to 8 μm, with the result that heat conductivity at that area is decreased to worsen the fixing ability. In comparison with heat conductivity of alumite and that of resin material, since the former is greater than the latter by about two units or figures, if the voltage resistance is increased by using the alumite layer, it is considered that the fixing ability is not almost worsened. Indeed, the fixing ability having any alumite layer is substantially the same as the fixing ability having no alumite layer.

In this way, in the illustrated embodiment, since the voltage resistance can be increased by providing the alumite coating layer, the current can be prevented from flowing into the recording material when the voltage is applied to the metal core of the fixing roller, thereby preventing toner scattering.

Further, in this case, since the alumite coating layer has good heat conductivity, reduction of heat conductivity due to provision of the voltage resistance layer can also be prevented.

The arrangement according to the illustrated embodiment is particularly effective for the reversal developing system in which toner scattering easily occurs.

Incidentally, in recent years, although fillers to be added to fluororesin which determines anti-offset ability and anti-wear ability which are important features of the fixing roller have been developed, properties required for such filler may be, for example, some inherent strength, low resistance and good dispersing ability within the fluororesin.

As examples of such filler, there are conductive composition including silica or silica containing substance and two-dimensional network of antimony containing tin oxide crystallite in which content of antimony is about 1 to 30 weight percent of tin oxide, and powder including forming particles of amorphous silica or silica containing substance surface-coated by two-dimensional network of antimony containing titanium oxide crystallite or particles including inert core substance having amorphous silica coating or silica containing coating, and so-called hollow dual shell conductive substance in which forming particles are formed from amorphous silica or silica containing substance hollow shells, or mica having surface subjected to conduction treatment by tin or antimony trioxide.

Incidentally, as shown in FIG. 3, regarding the above-mentioned arrangement, by using the conductive member as the fixing inlet guide and by applying voltage having polarity opposite to that of the developer to the fixing inlet guide, charges opposite to these of the developer can be applied to the recording material, with the result that, since the electrical attracting force between the developer on the recording material and the recording material is increased, toner scattering in the fixing operation can-be more reduced.

While the present invention is described in connection with the specific embodiment, the present invention is not limited to such an embodiment, but various alterations can be made within the scope of the invention.

What is claimed is:

1. A fixing roller comprising:

a conductive core member to which voltage is to be applied;

an aluminum oxidation layer provided on said conductive core member;

a surface conductive layer provided on said aluminum oxidation layer; and a primer layer provided between said aluminum oxidation layer and said surface conductive layer to adhere these layers.

2. A fixing roller according to claim 1, wherein said conductive core member is formed from aluminum, and said aluminum oxidation layer comprises an alumite coating layer obtained by subjecting a surface of said conductive core member to anode-oxidation-treating.

3. A fixing roller according to claim 1, wherein said surface conductive layer has mold releasing ability.

4. A fixing roller according to claim 3, wherein said surface conductive layer comprises a fluorine resin layer including conductive material.

5. A fixing roller according to claim 1, further comprising a heat generating source provided therein.

6. A fixing apparatus comprising:

a fixing roller for fixing an unfixed toner image to a recording material, said fixing roller including a conductive core member, an aluminum oxidation layer provided on said conductive core member, a surface conductive layer provided on said aluminum oxidation layer, and a primer layer provided between said aluminum oxidation layer and said surface conductive layer to adhere these layers; and a voltage applying means for applying voltage to said conductive core member of said fixing roller.

7. A fixing apparatus according to claim 6, wherein said conductive core member is formed from aluminum, and said aluminum oxidation layer comprises an alumite coating layer obtained by subjecting a surface of said conductive core member to anode-oxidation-treating.

8. A fixing apparatus according to claim 6, wherein said surface conductive layer has mold releasing ability.

9. A fixing apparatus according to claim 8, wherein said surface conductive layer comprises a fluorine resin layer including conductive material.

10. A fixing apparatus according to claim 6, wherein said fixing roller further includes a heat generating source provided therein.

11. A fixing apparatus according to claim 6, wherein said fixing roller contacts with the unfixed toner image on the recording material, and said voltage applying means applies voltage having the same polarity as that of toner to said fixing roller.

12. A fixing apparatus according to claim 6, further comprising a pressure roller cooperating with said fixing roller to form a nip therebetween, wherein, while the recording material bearing the unfixed toner image is sandwiched and conveyed at said nip, the unfixed toner image is fixed on the recording material.

13. A fixing apparatus according to claim 7, further comprising a guide member for guiding the recording material to said fixing roller, wherein voltage having polarity opposite to that of toner is applied to said guide member.

* * * * *

UNITED STATES PATENT AND TRADEMARK OFFICE

CERTIFICATE OF CORRECTION

PATENT NO. : 6,137,986

DATED : October 24, 2000

INVENTOR(S) : Osamu SUGINO, et al.

It is certified that error appears in the above-identified patent and that said Letters Patent is hereby corrected as shown below:

COLUMN 1

Line 28, "therein" should read --therein,--; and
Line 32, "phenomenon" should read --phenomenon,--.

COLUMN 2

Line 3, "resistance" should read --resistance,--; and
Line 47, "aluminium" should read --aluminum--.

COLUMN 3

Line 35, "7" should read --7,--; and
Line 444, "10 mm x 10 mm" should read --10 mm x 10 mm,--.

COLUMN 4

Line 17, "(10" should read --(1)--.

UNITED STATES PATENT AND TRADEMARK OFFICE

CERTIFICATE OF CORRECTION

PATENT NO. : 6,137,986

DATED : October 24, 2000

INVENTOR(S) : Osamu SUGINO, et al.

It is certified that error appears in the above-identified patent and that said Letters Patent is hereby corrected as shown below:

COLUMN 5

Line 20, "can-be" should read --can be--.

COLUMN 6

Line 40, "claim 7," should read --claim 6,--.

Signed and Sealed this

Eighth Day of May, 2001

*Attest:*

Nicholas P. Godici

NICHOLAS P. GODICI

*Attesting Officer*

*Acting Director of the United States Patent and Trademark Office*